United States Patent [19]

Kuper et al.

[11] Patent Number: 4,687,035

[45] Date of Patent: Aug. 18, 1987

[54] MACHINE FOR PROCESSING PLYWOOD SHEETS

[76] Inventors: Hans-Heinrich Kuper, Jüddeldamm 24; Theo Grönebaum, Eschenweg 24a, both of 4835 Rietberg, Fed. Rep. of Germany

[21] Appl. No.: 822,896

[22] Filed: Jan. 27, 1986

[30] Foreign Application Priority Data

Feb. 2, 1985 [DE] Fed. Rep. of Germany ..... 3503573

[51] Int. Cl.[4] ..... B27B 1/00; B27M 3/00

[52] U.S. Cl. ..... 144/2 R; 83/371; 83/613; 83/697; 144/245 A; 144/246 E; 144/246 G; 144/356; 144/363

[58] Field of Search ..... 271/258, 259; 198/341; 144/245 R, 245 A, 242 M, 246 R, 246 G, 2 R, 356, 246 E, 363; 83/362, 371, 372, 613, 697

[56] References Cited

U.S. PATENT DOCUMENTS

| | | | |
|---|---|---|---|
| 3,370,493 | 2/1968 | Donley, et al. | 83/372 |
| 3,776,078 | 12/1973 | Perlman | 83/371 |
| 3,780,777 | 12/1973 | Davies | 83/371 |
| 3,845,679 | 11/1974 | Rhotert | 83/362 |
| 4,008,639 | 2/1977 | Hasegawa | 83/371 |
| 4,340,137 | 7/1982 | Foster | 144/245 A |

*Primary Examiner*—W. D. Bray

*Attorney, Agent, or Firm*—Erwin S. Teltscher

[57] ABSTRACT

A machine for processing plywood sheets which pass one behind the other includes a horizontal transporting and supporting roller, a cutter located above the roller and movable toward and away from the roller, a transporting device including a machine table and at least one transporting band rotatable about the machine table, and a testing device for rejecting defective plywood sheets or sheet portions, which has a plurality of testing rollers supported on pivotable parallel levers and is located above the machine table, so as to abut against the plywood sheets which are transported by the transporting device.

12 Claims, 4 Drawing Figures

MACHINE FOR PROCESSING PLYWOOD SHEETS

BACKGROUND OF THE INVENTION

The present invention relates to a machine for processing plywood sheets which are continuously conveyed in a follow-on sequence one behind the other. More particularly, it relates to a machine of the above-mentioned type which has a horizontal transporting and supporting roller, and a cutter which is movable above the roller toward and away from the roller, a sensing device, for rejecting defective plywood sheets, or sheet portions, and a transporting device which includes at least one transporting band arranged ahead of the transporting and supporting roller for transporting the plywood sheets.

Machines of the above-mentioned type are known in the art. In such a known machine the plywood sheets, which are supplied one behind the other to the region of the cutter, are tested there, and the portions of the plywood sheets which, for example, do not have the required thickness, are cut off. Testing of these waste portions is performed above the transporting and supporting roller, on which the plywood sheet is supported tangentially. Utilization of the outer surface of the transporting and supporting roller as an "abutment table". for the plywood sheet region to be tested has the disadvantage, however, that the accuracy of the testing is somewhat inadequate, because of the curved surface of the transporting and supporting roller. Moreover, any deviations of the outer surface of the transporting and supporting roller from an exactly circular cylindrical shape have an unfavorable effect on the accuracy of the testing of the thickness of the plywood sheets. This deviation from the circular cylindrical shape is known to be denoted as a "bump".

SUMMARY OF THE INVENTION

Accordingly, it is an object of the present invention to provide a machine for processing plywood sheets with a considerably more accurate testing device which measure the thickness of the passing plywood sheets. A machine which is so designed should control, for example, testing of plywood sheets whose thickness amounts to only 0.5 mm.

In keeping with these objects and with others which will become apparent hereinafter, one feature of the present invention resides, briefly stated, in a machine in which the testing device includes several identical testing rollers supported on pivotable parallel levers and arranged so that the testing rollers abut, above a machine table of the transporting device, against the plywood sheet which is transported thereon.

When the machine is designed in accordance with the present invention, a machine table with a flat horizontal upper surface is therefore used as a support for the passing plywood sheets, which are supported through the transporting bands, so that the support does not change at the location of the testing rollers. In contrast thereto, in the known machine a continuous change of the support takes place, since there the rotatable transporting and supporting shaft serves as a support during the transporting step.

In accordance with another advantageous feature of the present invention, each pivotable lever which supports the testing roller, is formed as an angular lever which is pivotably arranged on a pivoting axle extending transversely to the transporting direction at a line of intersection of the two legs of the angular lever. The pivoting axle is supported in a fixed lever support. The utilization of the angular lever allows a "step up" or magnification of the lever deflection, which is caused by any thickness changes of the passing plywood sheets. While the lower leg of the angular lever, which carries the testing roller, is short, its upper leg has a considerably greater length, so that the lever deflection at the free end of the upper leg is amplified. The value of any deviation in thickness can then be supplied to an actuating member of an electric microswitch.

The inventive machine has several further features which advantageously distinguish it from the known machines; the protective scope extends not only to the individual features, but also to a combination thereof.

The machine, in accordance with the present invention, is connected with an electrical control device, which coordinates the operation of the individual devices. As long as only one testing roller reports, through an angular lever, any unacceptable thickness deviation of the plywood sheet, a corresponding circuit is actuated, and interrupts the transportation of the plywood sheets with a time delay of, for example, 1/10 sec. The plywood sheet then moves forwardly so that it reaches, with a transition line thereof, which defines the limits of the damaged region, the support for cutting; this support, in turn, is formed by the now stationary transporting and supporting roller. Thus cutting is accomplished by the cutter being displaced in a direction toward the surface of the transporting and supporting roller. Then the above-mentioned circuit is automatically turned on, so as to continue the transportation of the plywood sheets.

In the machine, in accordance with the present invention, the stations for the cutting and for the testing are separated from one another, so that it is possible, because of the unchanging surface of the machine table below the testing rollers, to carry out a very accurate testing of the thickness of the plywood sheets, and to subsequently use the transporting and supporting roller during its short time of stoppage as a support for cutting of the plywood sheets.

The novel features of the present invention are set forth in particular in the appended claims. The invention itself, however, will be best understood from the following description of the preferred embodiment, which is accompanied by the appended drawings.

DESCRIPTION OF A PREFERRED EMBODIMENT

Figure 1:
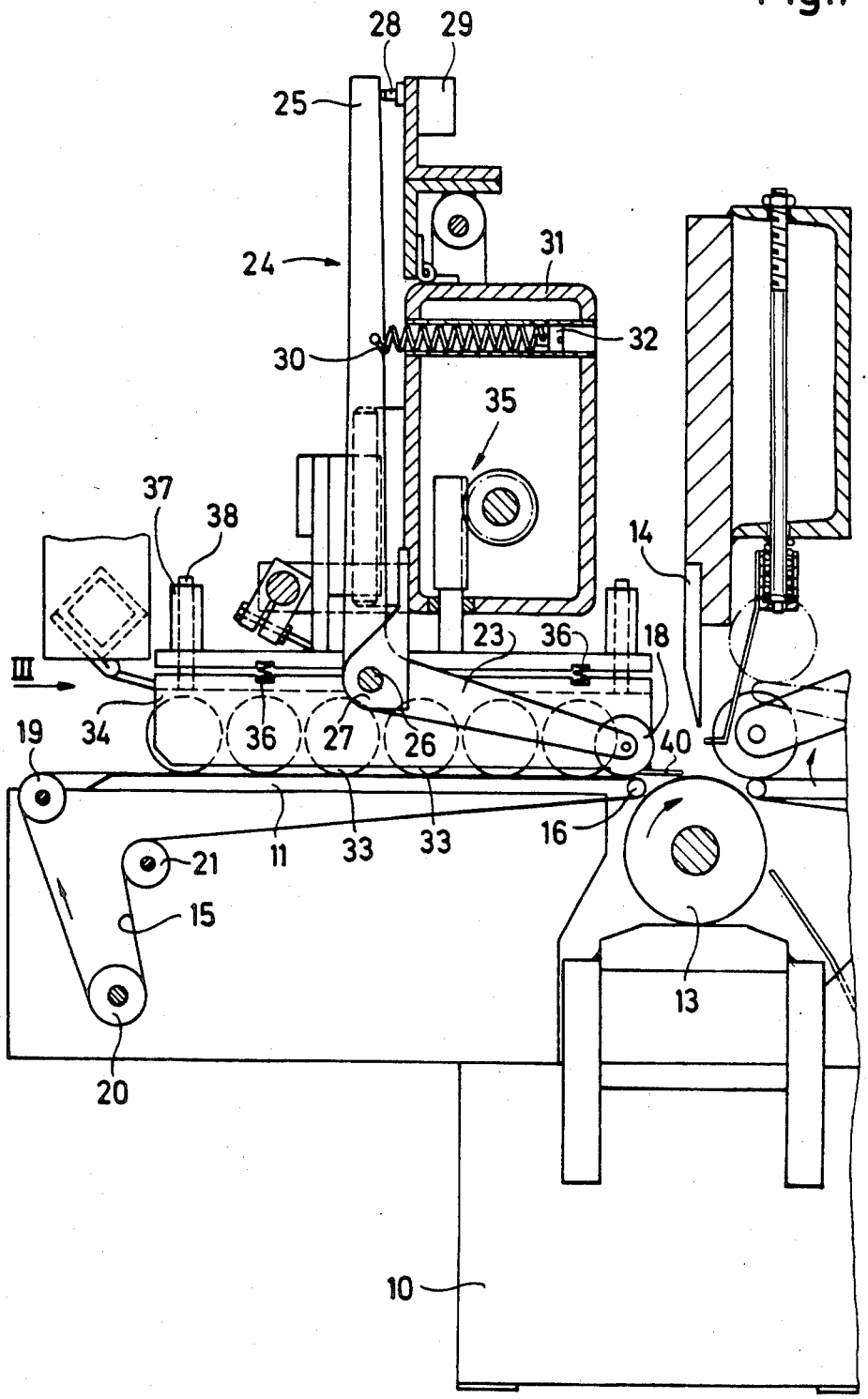
FIG. 1 is a side view of a machine for processing plywood sheets in accordance with the present invention, in a partial vertical section.
Figure 2:
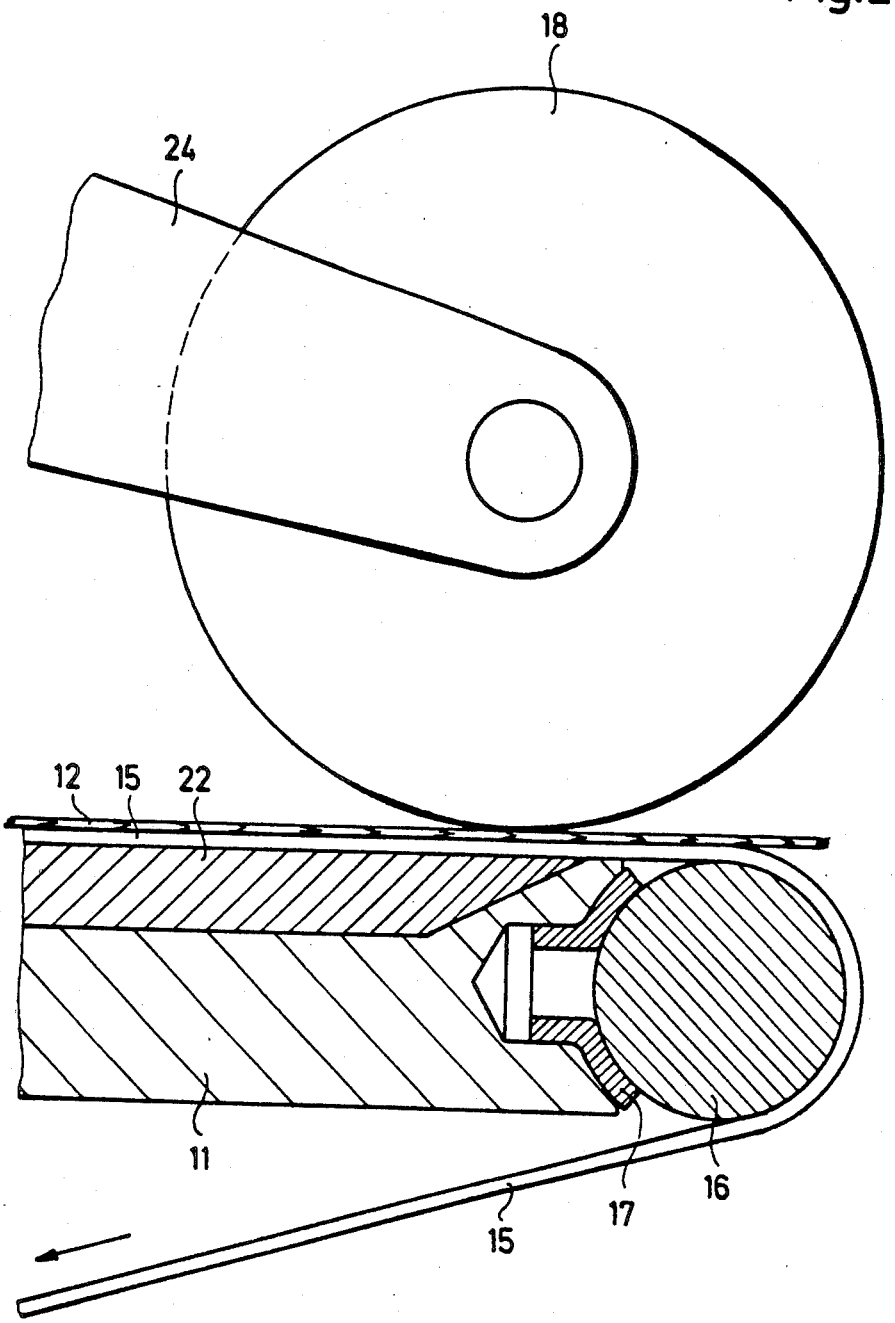
FIG. 2 is a large-scale view showing a testing region of the machine illustrated in FIG. 1.
Figure 3:
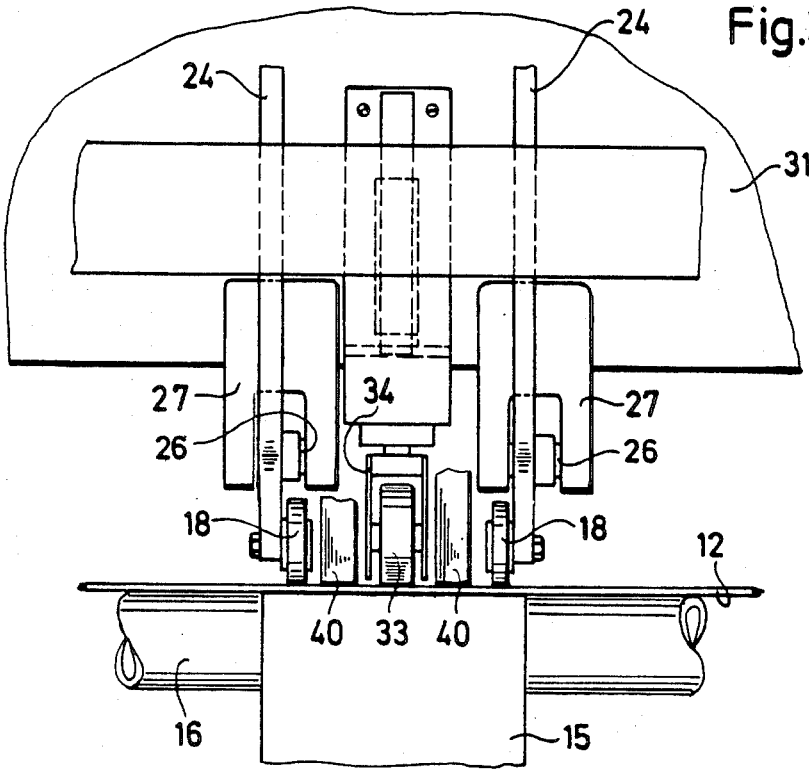
FIG. 3 is a front view of the plywood sheet inlet side of the machine, as seen along the direction of the arrow III in FIG. 1.

A machine for processing plywood sheets in accordance with the present invention includes a machine frame 10 with a horizontal machine table 11, which forms both a transporting device for plywood sheets 12, and a part of a sensing/testing device for testing the thickness of the passing plywood sheets 12. A cutting station is arranged downstream of the machine table 11, as considered in a transporting direction. The cutting station has a horizontal transporting and supporting roller 13, and a cutter 14, which is vertically displaceable above the roller 13. The cutter 14 moves toward the transporting and supporting roller 13 in a direction perpendicular to the transporting direction, and is arranged to cut the plywood sheets 12 supported on the outer surface of roller 13.

The transporting device includes a plurality of substantially identical transporting bands 15 arranged parallel to, and spaced from one another. They are formed as endless bands, which rotate on the machine table 11, and slide above the machine table 11 over a part of their length. The transporting bands 15 are tensioned over several shafts. A horizontal rerouting shaft 16 is located opposite to the transporting and supporting roller 13, and is supported in a segment-bearing shell 17, which, in turn, is mounted at a discharge end of the transporting device on the machine table 11. This support of the rerouting shaft 16 ensures an accurate guidance of all transporting bands 15 in the region adjacent to the transporting and supporting roller 13. In this region several sensing or testing rollers 18 control the thickness of the plywood sheets 12, which pass over the transporting bands 15. Further rerouting shafts 19, 20 and 21 are arranged at the inlet end of the transporting device. It is also possible that the rerouting shaft 20 can simultaneously form a driving shaft for the transporting bands 15. An abutment plate 22 is embedded in the machine table 11 over the greater part of its length so as to improve the sliding of the transporting bands 15.

The testing rollers 18, which are provided for testing the thickness of the passing plywood sheets 12, are each supported on pivotable levers. In the illustrated example two testing rollers 18 are arranged above each transporting band 15, and have horizontal axes extending transversely to the transporting direction. These two testing rollers 18 are supported on lower legs 23 of angular levers 24. Each angular lever 24 also has an upright leg 25 which is considerably longer than the lower leg 23. Each angular lever 24 is supported in the connecting region of its legs, for pivoting about a horizontal pivoting axle 26. The pivoting axle 26 also extends transversely to the transporting direction, similarly to the axes of the testing rollers 18, and is held in a fixed lever support 27. The testing roller 18 is pivotably supported on the free end of the lower leg 23 of the angular lever 24, while the free end of the upright leg 25 is arranged in contact with an actuating element 28 of a microswitch 29, which is rigidly secured to the machine.

A helical spring 30 is arranged inside a fixed housing 31 located above the transporting device. One end of the helical spring 30 pulls the upright leg 25 toward the housing 31, and thereby presses the testing roller 18 on the lower leg 23 against the plywood sheet 12, which plywood sheet 12 is supported in turn, lies on the transporting band 15, and on the machine table 11. The tensioning of the helical spring can be changed by means of an adjusting screw 32 connected to the other end of the helical spring 30.

Prior to reaching the testing region, the plywood sheet 12 is pressed over a greater part of its path, by means of pressing rollers 33, against the transporting bands 15 and against the machine table 11. It thereby approaches in a fully flat form the sensing or testing region which, in turn, includes the testing rollers 18. In the illustrated example, six pressing rollers 33 are arranged above each transporting band 15, one after the other, in the transporting direction. All pressing rollers 33 above each transporting band 15 are supported in a downwardly open, and as seen in cross-section, U-shaped roller holder 34. The axes of the pressing rollers 33 extend similarly to the axes of the testing rollers 18 and the axes of the transporting and supporting roller 13, transversely to the transporting direction A toothed rack drive 35 is arranged in the housing 31 for lifting or lowering of the roller holder 34. The pressing forces are uniformly distributed by means of helical springs 36 arranged between the roller holder 34 and the toothed rack drive 35. A small degree of relative displacement between the toothed rack drive 35 and the roller holder 34 is allowed by means of guiding brushes 37 provided with guiding pins 38.

Figure 4:
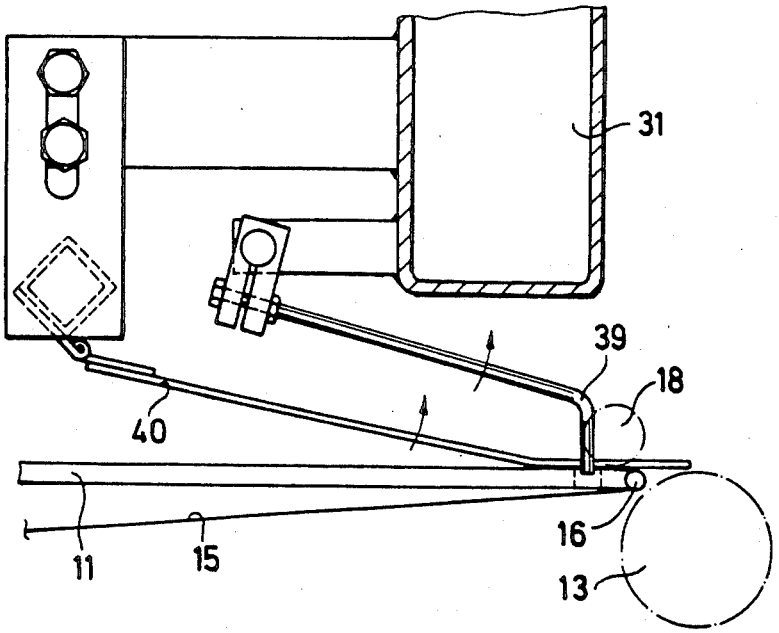
FIG. 4 is a partially sectioned sideview schematically showing auxiliary devices for the testing and cutting region of the machine.

FIG. 4 schematically shows auxiliary devices of the machine, which ensure precise and accurate operation of the machine. The machine has several upwardly pivotable abutment fingers 39 arranged so that the oncoming rectangular plywood sheets 12 abut against the abutment fingers 39 with their front edges and, thereby the plywood sheets 12 are exactly positioned at right angles to the transporting direction. Moreover, the machine is provided with upwardly pivotable holding-down members 40, which press the plywood sheets 12, in the vicinity of their cutting location, toward the transporting and supporting roller 13.

The machine in accordance with the present invention operates in the following manner. A plywood sheet 12, for example of a rectangular shape, is placed onto the machine table 11 at the inlet region thereof, and onto the transporting bands 15 rotating thereat, and is then moved by the transporting bands from the inlet region to the region of the pressing rollers 33. Subsequently the plywood sheet 12 arrives at a location below the testing rollers 18 of the sensing or testing device. To the extent the thickness of the passing plywood sheets 12 fluctuates there within desired limits, further transportation of the plywood sheets 12 takes place over the transporting and supporting roller 13, so that the plywood sheet 12 is then discharged from the machine. If a plywood sheet 12 has, however, a fault, for example a region with too small a thickness, or is formed with a hole, the distance of the testing roller 18 from the surface of the machine table 11 in this region changes during passage of the defective plywood sheet 12. The testing roller 18 approaches the machine table 11 by a measure, which then corresponds, at that location and time, to any non-available portion of a plywood sheet 12, namely a plywood sheet 12 which is not of a normally required thickness. The angular lever 24 thereby pivots around its pivoting axle 26, so that the free end of the upright leg 25 covers a sufficiently large pivoting path to actuate the microswitch 29 via the actuating member 28. This pivoting path is actually magnified with respect to the length of the lower leg 23, since the length of the upright leg 25 is considerably greater than the length of the lower leg 23. Therefore even a very small thickness change of the plywood sheet 12 sensed by the testing roller 18 can cause a sufficiently large deflection of the actuating member 28.

Actuation of the microswitch 29 causes the machine to turn off the entire transporting process after only a short time. This time is preselected so that the plywood sheet 12 arrives with a transition line thereof on the transporting and supporting roller 13 disposed at its cutting location below the cutter 14, and where the transition line is defined as a border between the good region having a desirable thickness, and the defective region; at that time the transporting step is interrupted. Then the cutter 14 is moved downwardly and cuts off the damaged part along the entire width of the plywood sheet. The circuitry of the machine is designed so that the cutter 14 cuts off from the plywood sheet 12 a strip containing the damaged region, namely it moves downwardly and upwardly twice, while between these two steps the plywood sheet is advanced along a length in the transporting direction, which corresponds to the length of the damaged part. The strips with the damaged parts, or waste strips can be sorted by a special discharging device located downstream of the transporting and supporting roller 13 along the transporting direction, so that the good plywood sheets and the waste strips are further transported separately from one other.

The diameter of the rerouting shaft 16 is considerably smaller than the diameter of the transporting and supporting roller 13. In this manner it is possible to arrange the testing region very close to the surface of the transporting and supporting roller 13, so as to minimize any possible fault borders caused by the actual transportation time.

When the plywood sheet 12 enters the machine, the pressing rollers 33 are located in their lifted position. The plywood sheet 12 is aligned along the downwardly directed abutment fingers 39. Then the lowering of the pressing rollers 33 and the upward pivoting of the abutment fingers 39 take place simultaneously, so that the plywood sheet 12, which is released at its front edge, is forced to be transported by the transporting bands 15, and by the pressing rollers 33.

The present invention is not limited to the details shown, since various modifications and structural changes are possible without departing in any way from the spirit of the present invention.

What is desired to be protected by Letters Patent is set forth in particular in the appended claims.

We claim:

1. A machine adapted for processing relatively thin plywood sheets of a fluctuating thickness continuously conveyed one behind the other, comprising in combination a machine table, including transporting means for transporting plywood sheets in a transporting direction, cutting means for cutting the plywood sheets, sensing means for testing the thickness of the plywood sheets, said sensing means including a plurality of pivotable parallel levers, and a plurality of substantially identical testing rollers, each testing roller being arranged on a respective one of said pivotable parallel levers, being located above said machine table, and being adapted to abut against said plywood sheets transported by said transporting means, wherein said transporting means includes at least one transporting band which is rotatably arranged on said machine table, and is arranged upstream of said transporting and supporting roller as considered in the transporting direction, an abutment plate disposed on said machine table below said transporting band facilitating sliding of said transporting band thereover, wherein said cutting means includes a horizontally positioned transporting and supporting roller, and a cutter movable upwardly and downwardly above said transporting and supporting roller, a rerouting shaft arranged opposite said transporting and supporting roller, and having a diameter considerably smaller than that of the latter, at least one of said testing rollers being arranged above each of said transporting bands very close to a surface of said rerouting shaft, and supporting means for supporting said rerouting shaft, and being free of any axle supporting the latter, but including a segment bearing shell which is mounted on said machine table, and supports said rerouting shaft in a region which faces away from the transporting band, a portion of said transporting band opposite said segment bearing shell passing over said rerouting shaft and pressing the latter against said segment bearing shell constituting a remainder of said supporting means, so that an accurate guidance of said supporting band is ensured in a region adjacent to said transporting and supporting roller.

2. A machine as defined in claim 1, wherein said transporting means include additional transporting bands which are rotatable on said machine table, being spaced at respective distances from one another, and being disposed parallel to one another.

3. A machine as defined in claim 1, wherein each of said pivotable levers is formed as an angular lever which has two legs intersecting one another at an intersection line, and further comprising means for pivotably supporting each of said angular levers, and including a pivoting axle which is arranged at said intersecting line, and extends transversely to the transporting direction, and a fixed lever support which supports said pivoting axle.

4. A machine as defined in claim 1, wherein each of said pivotable levers is formed as an angular lever having an upright leg and a lower leg with a free end, each of said testing rollers being supported on said free end of said lower leg of a respective one of said angular levers.

5. A machine as defined in claim 4, wherein said supporting means are normally in operation, and further comprising switching mens arranged for turning off the operation of said transporting means, said upright leg of each of said angular levers having a free end arranged to actuate said switching means.

6. A machine as defined in claim 5, wherein said switching means includes an electrical microswitch provided with an actuating member, said free end of said upright leg of each of said angular levers being arranged to contact said actuating member of said electrical microswitch.

7. A machine as defined in claim 6, and further comprising a fixed housing, and helical spring means arranged in said fixed housing having one end therof connected with said upright leg of each of said angular levers, and serving to urge said upright leg into contact with said actuating member of said electrical microswitch.

8. A machine as defined in claim 7, and further comprising means for adjusting said helical spring means, and including an adjusting screw disposed in said fixed housing, and connected with the other end of said helical spring means.

9. A machine as defined in claim 1, wherein said transporting means includes additional transporting bands rotatable on said machine table, each having an upper transporting band portion, said testing rollers being arranged so that two testing rollers are located above each of said transporting bands, and further comprising a plurality of pressing rollers arranged behind one another along a line extending between said two testing rollers and parallel to said upper transporting band portion.

10. A machine as defined in claim 9, and further comprising a height-displaceable roller holder arranged to hold all of said pressing rollers.

11. A machine as defined in claim 10, and further comprising a housing, a toothed rack drive arranged in said housing and acting upon said roller holder for the height displacement thereof, and helical springs interposed between, and connecting said roller holder with said toothed rack drive.

12. A machine as defined in claim 1, wherein said transporting means includes additional transporting bands rotatable about said machine table, and further comprising a plurality of upwardly pivotable abutment fingers which are located between two of said transporting bands, said abutment fingers being located in a row which extends transversely to the transporting direction.

* * * * *